US006062895A

United States Patent [19]

Lin et al.

[11] Patent Number: 6,062,895

[45] **Date of Patent: *May 16, 2000**

[54] PATCH PLUG WITH CONTACT BLADES

[75] Inventors: Mike H. Lin, Cerritos; David J. Roe, Long Beach, both of Calif.

[73] Assignee: International Connectors and Cable Corporation, Cerritos, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/116,006

[22] Filed: Jul. 15, 1998

[51] Int. Cl.[7] ..... H01R 4/24; H01R 4/26; H01R 11/20

[52] U.S. Cl. ..... 439/404; 439/405

[58] Field of Search ..... 439/445, 447, 439/404, 405, 927, 941, 403

[56] References Cited

U.S. PATENT DOCUMENTS

| | | | |
|---|---|---|---|
| 3,692,966 | 9/1972 | Lancaster | 200/51.1 |
| 3,874,763 | 4/1975 | Hoover . | |
| 3,901,575 | 8/1975 | Hoover . | |
| 4,080,040 | 3/1978 | Lancaster . | |
| 5,226,835 | 7/1993 | Baker, III et al. | 439/403 |
| 5,266,042 | 11/1993 | Hampel | 439/188 |
| 5,460,545 | 10/1995 | Siemon et al. | 439/308 |
| 5,601,447 | 2/1997 | Reed et al. | 439/404 |
| 5,609,499 | 3/1997 | Tan et al. | 439/445 |
| 5,624,274 | 4/1997 | Lin | 439/417 |
| 5,634,817 | 6/1997 | Siemon et al. | 439/608 |
| 5,643,005 | 7/1997 | Weidler et al. | 439/405 |
| 5,915,989 | 6/1999 | Adriaenssens et al. | 439/404 |
| 5,971,792 | 10/1999 | Lin | 439/404 |
| 5,975,936 | 11/1999 | Lin et al. | 439/404 |

OTHER PUBLICATIONS

ICC Premise Wiring Solutions Catalog (front cover, back cover, pp. 26 and 29), published more than 1 year prior to filing date Jun. 1996.

*Primary Examiner*—Lincoln Donovan
*Assistant Examiner*—Michael C. Zarroli
*Attorney, Agent, or Firm*—Christie, Parker & Hale, LLP

[57] ABSTRACT

A patch plug for connection to a 110-type connector block having a plurality of spaced apart electrical conductors. Each conduction has an insulation displacement contact at a back end thereof and a contact blade at a front end thereof. A dielectric housing contains the spaced apart electrical conductors and maintains them aligned in a predetermined position such that the insulation displacement conductors are disposed rearwardly of the respective blades, are arranged upwardly, and are aligned in a single row transverse to the direction of insertion of the contact blades into the 110-type connector block. A contact protection block is formed around the single row of insulation displacement contacts and includes two outer side walls one at each end of the single row of insulation displacement contacts. Intermediate walls are located between and extending above the insulation displacement contacts of adjacent conductors. Each conductor is configured to maximize space between adjacent conductors of different circuits and reduce exposed parallel surface area of adjacent conductors to thereby reduce or prevent crosstalk and signal interference. Additionally, the patch plug includes a strain relief boot mounted at a rear end of the patch plug.

5 Claims, 13 Drawing Sheets

PATCH PLUG WITH CONTACT BLADES

This invention relates to electrical connectors and, in particular, to a patch plug for electrically connecting a bundle of wires to a linear array of insulation displacement contacts

BACKGROUND OF THE INVENTION

Modern commercial buildings include an abundance of communications equipment. Individual offices within the building are often equipped with telephones and fax machines, as well as computers that are interconnected with other computers through high speed communication networks. For ease of administration, apparatus for interconnecting such equipment (with each other and with outside networks) is centralized via interconnection (cross-connect) panels that serve the entire building.

A typical cross-connect panel includes several 110-type connector blocks each having an array of insulation displacement contacts (IDCs) for terminating large bundles of telephone wires. IDCs are commercially available and designed to facilitate making mechanical and electrical connection to a wire—particularly a wire that is surrounded by dielectric insulation. Each IDC includes a pair of opposing contact fingers that strip insulation from a wire that is pressed between the contact fingers so that an electrical contact is made between the wire and the IDC. Each IDC accommodates a single wire pressed between its opposing contact fingers, and is so compact that many IDCs can fit into a small area.

Several arrays of IDCs may be used to terminate a bundle of wire from a telephone central office while other arrays on the cross-connect panel may be used to terminate bundles of wire from telephone equipment within the building. Interconnecting particular wires from one bundle with particular wires from another bundle is accomplished with a patch cord comprising a cord with a plug (patch plug) attached to each end. The cord includes several wires within a plastic jacket. The patch plugs include a number of contact blades that are designed to be pressed into an equal number of IDCs within an array thereof. Once wired, a patch plug is a multiple wire connector that may be installed and removed from the cross-connect panel for the purpose of branching off existing lines or connecting together discrete areas of the terminal field.

One type of patch plug used in connection with the 110-type connector block is described in U.S. Pat. No. 5,226,835, which is incorporated herein by reference. The patch plug includes a two-piece dielectric housing which snaps together and captures several conductors therein. Each of the conductors includes an insulation displacement contact at one end for receiving individual wires from a cord and a contact blade at the other end for inserting into the IDCs of the 110-type connector block. A cord comprising a bundle of insulated wires, surrounded by an insulating jacket, is prepared for connection to the conductors by stripping away a small portion of the jacket to expose the insulated wires. The insulated wires may then be placed into the underside of the upper housing member which includes narrow channels for holding the wires in fixed positions. Thereafter, the upper housing member may be snapped onto the lower housing member by pressing them together. The wires are then collectively pressed/seated into the IDCs of the conductors. A disadvantage of this type of patch plug is that the IDCs are exposed and may be damaged or bent either before or during assembly. In addition, because termination tools may damage the exposed contacts, termination is typically done by hand, which can result in inefficiencies and excessive waste.

Another type of patch plug is described in U.S. Pat. No. 5,460,545. This patch plug includes an insulative plastic housing having three separable parts, a lower first housing, an upper second housing and a contact insulator housing. The patch plug also includes a plurality of conductors in the insulator housing, each conductor having an IDC at one end and a blade portion at the other end. As with the previous patch plug, the IDCs of the conductors are exposed and subject to damage.

Both of the above mentioned patch plugs also present additional difficulties. First, since the patch plugs are limited in width size to permit installation of adjacent patch plugs to the 110-type connecting block without missing terminal locations that may require access, a very tight clearance exists between the endmost insulation displacement contacts of the conductors and the side walls of the patch plug housing, inhibiting the use of a contact protection block around the contacts. Second, since the wires remain in the housing, they must be carefully trimmed, adding to installation time and the increased possibility of error. Failure to adequately trim can result, among other things, in wires being jammed between the termination cap and the rest of the housing, preventing proper termination. Third, it is difficult to remove these patch plugs once they are mounted to a termination block, especially when several patch plugs are mounted side-by-side, since it is difficult to build up a sufficient grasping force on the upper and lower surfaces of the plug housing when attempting to pull the plug out.

An additional problem found in many patch plugs is the existence of crosstalk. This occurs when exposed wires or conductors carrying different signals are placed too close to one another, thereby allowing electrical interference between the signals. This often results in telephone users being able to hear other users' conversations, fax machine or computer signals, or static sounds. Generally, two conductors are required to complete a circuit and service each telephone line, fax machine or computer modem. The wires to complete each circuit are usually paired and inserted into the insulation displacement contacts in the patch plug adjacent to one another. This creates the situation where one conductor of one pair is connected to a different circuit than one adjacent conductor of an adjacent pair. Close proximity of electrical conductors of adjacent pairs is a major contributor of crosstalk. The conductors of a 110 patch plug must have specific spacing at the front of the patch plug in order to connect with an array of IDCs. These dimensions on prior art patch plugs are close enough to generate crosstalk between adjacent circuits.

Another disadvantage of the above mentioned patch plugs is that they do not provide for adequate strain relief for the cord comprising a bundle of insulated wires. Because arrays of IDCs in office settings are often installed in closets or other areas with limited floor space, it is common to mount these arrays on a wall. When a patch plug is used to connect wires to these wall mounted IDC arrays, the cord which is stripped and inserted into the back of the patch plug often hangs from the back of the patch plug. The patch plugs are composed of a hard plastic dielectric housing that terminate at their cord ends with an opening for inserting and securing the cord. When these patch plugs are used, the weight of the cord causes the hanging cord to bend at close to a ninety degree angle. The effect of this bending action is that the hard plastic opening in the patch plug housing tends to crimp the wires contained within the cord. This crimping can damage the wires, cause interference between the different signals carried in the wires, reduce the service life of the wires and cause a general degradation of the performance of the wires.

In view of the above, it should be appreciated that there is still a need for a patch plug that may be readily installed in the field by hand or by a punchdown tool, that may be readily removed and reinserted at a different location on the cross-connect panel having IDCs that are protected from damage, that minimizes crosstalk and other interference, and that provides adequate strain relief for the cords to which they are attached.

SUMMARY OF THE INVENTION

The present invention is embodied in a patch plug having insulation displacement contacts that are protected from damage before and during assembly. The new patch plug also permits punchdown termination for a clean and secure connection or, alternatively, an easy to use housing cover may be employed for toolless termination without careful trimming of the wires being required prior to termination. The patch plug is contoured to permit easy removal and reinstallation onto a 110-type connector block. The patch plug also reduces crosstalk and other signal interference. In addition, the patch plug provides strain relief for the cord to which it is attached.

The patch plug of the present invention includes a plurality of spaced apart electrical conductors. Each conductor includes an insulation displacement contact at a back end thereof and a contact blade at a front end thereof. The contact blade is adapted for insertion into a 110-type connector block. A dielectric housing contains the spaced apart electrical conductors and maintains them aligned in predetermined positions such that the insulation displacement contacts are disposed rearwardly of their respective blades, are arranged upwardly, and are aligned in a single row transverse to the direction of insertion of the patch plug into the 110-type connector block.

A feature of the present invention is that a contact protection block is formed around the single row of insulation displacement contacts. The contact protection block has two outer side walls, one at each end of the single row of insulation displacement contacts, and intermediate walls located between and extending above the insulation displacement contacts of adjacent conductors. The contact protection block also defines a plurality of slots for receiving and guiding a plurality of communication wires, respectively, into conductive engagement with the insulation displacement contacts of the conductors. An advantage of the contact protection block is that it prevents damage to the contact pins prior to and during assembly.

In a preferred embodiment, the contact protection block extends the full width of the patch plug. Thus, a standard width may be maintained for the patch plug that is suitable for use with 110-type connector blocks, without missing terminal locations that may require access when the patch plugs are mounted immediately adjacent to each other.

In a further preferred embodiment, the contact protection block is part of a conductor holder that receives and holds the plurality of spaced apart electrical conductors and that forms an upper lip at the front end of the patch plug partially defining the opening that exposes the contact blades for insertion into the 110-type connector block. Such a construction reduces the number of parts that otherwise would be required if the contact protection block were separately made.

Another feature of the present invention is that the housing may include a cover having a front edge that defines a plurality of wire channels for receiving a plurality of communication wires. An advantage of this feature is that the communication wires may be brought through and guided by the cover of the patch plug to provide easier field termination, since careful trimming is not required.

Another feature of the present invention is that adjacent electrical conductors are paired and portions of the conductors of the same pair are closer together than portions of different pairs of electrical conductors. An advantage of this feature is the reduction or prevention of crosstalk and signal interference. Within the housing, electrical contact bars connect the front end of the conductor with the back end. In the present invention, contact bars which are adjacent to one another and would normally be involved in a complete circuit are paired and offset toward one another. In turn, this increases the distance between adjacent electrical contact bars of different circuits. By increasing the distance between electrical contact bars of adjacent pairs of conductors, interference between adjacent circuits may be reduced resulting in a subsequent reduction in crosstalk.

An additional feature of the present invention is that the conductors are configured to reduce or prevent crosstalk and signal interference by minimizing the amount of parallel exposure of one contact blade to another. This is accomplished by having two different configurations of contact blades. One configuration includes an upright bar to connect to the array of IDCs and a lower longitudinal bar connecting the bottom of the upright bar and the rest of the conductor. The second configuration includes an upright bar to connect to the array of IDCs and an upper longitudinal bar connecting the top of the upright bar to a connector post which is connected to the rest of the conductor. When these two configurations are paired and pairs of conductors are placed in a parallel arrangement, the distance between longitudinal bars of adjacent conductors is maximized. Additionally, the amount of parallel surface area exposure of adjacent pairs of conductors is reduced. Each aspect of this feature consequently helps to reduce or prevent crosstalk and signal interference.

A further feature of the present invention is that the upper and lower exterior surfaces of the housing of the patch plug may be provided with gradual inclined or ramped surfaces increasing in depth in a longitudinal direction from an intermediate portion of the patch plug to a rear portion of the patch plug. The ramped surfaces permit easier removal and reinsertion of the patch plug at different locations of the 110-type connector block.

An additional feature of the present invention is a dielectric, flexible, strain relief boot which is mounted at the rear end of the patch plug and which receives the cord. In the preferred embodiment, the strain relief boot includes an anchor which is rectangular in shape and has a greater width than height. This anchor is inserted into the housing so that the anchor is braced against the rear exterior wall of the dielectric housing, while the remainder of the strain relief boot projects outside the housing from an opening in the rear of the housing. This feature provides the advantage of allowing the strain relief to be firmly anchored in the housing and to prevent sharp, ninety degree bends in the cord which could damage the wires within the cord and degrade the signals carried by those wires.

The strain relief boot may also include transverse and axial ribs. These ribs serve to strengthen the strain relief boot and to control the angle of the bend allowed by the strain relief boot.

Other features and advantages of the present invention will become apparent from the following description of the preferred embodiments, taken in conjunction with the accompanying drawings, which illustrate, by way of example, the principles of the invention.

DETAILED DESCRIPTION OF THE PREFERRED EMBODIMENT

Figure 1:
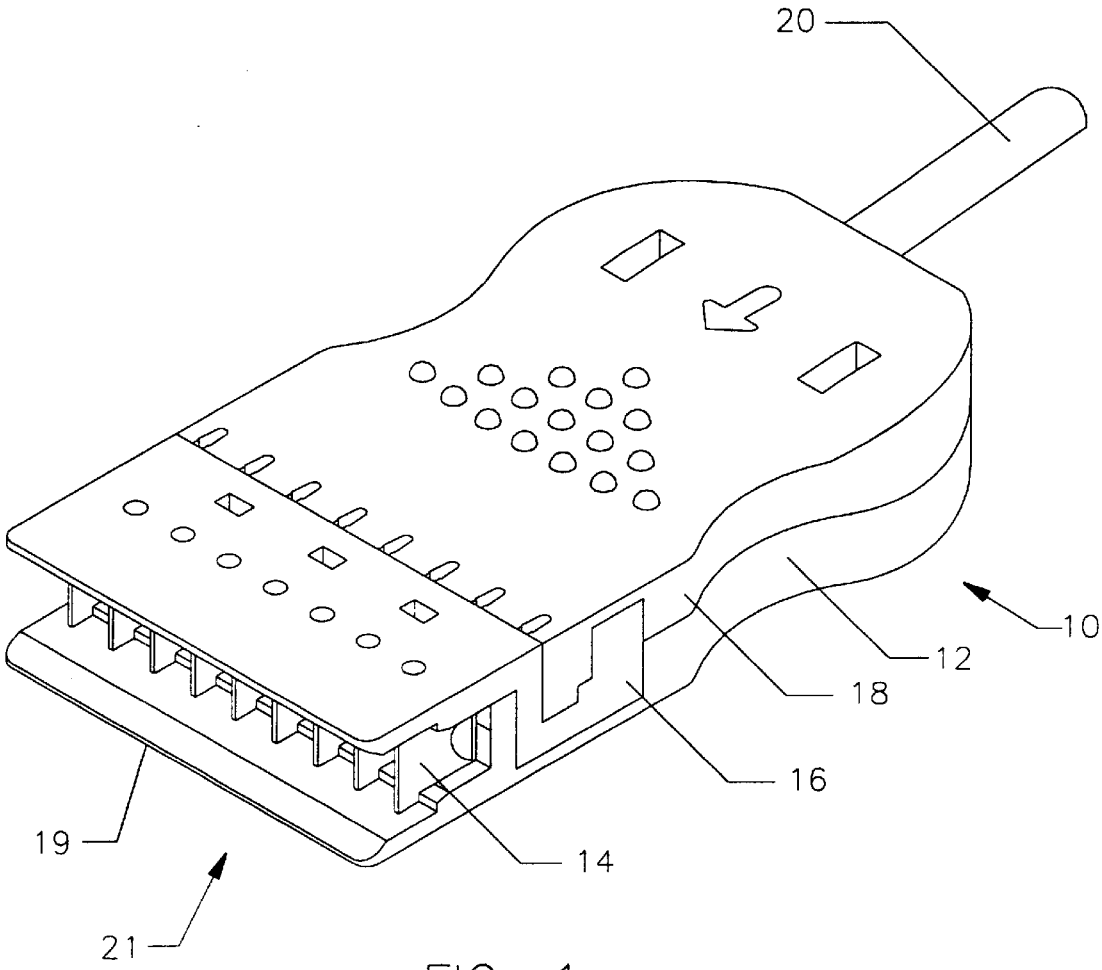
FIG. 1 is a top perspective view of an assembled patch plug according to the present invention.
Figure 2:
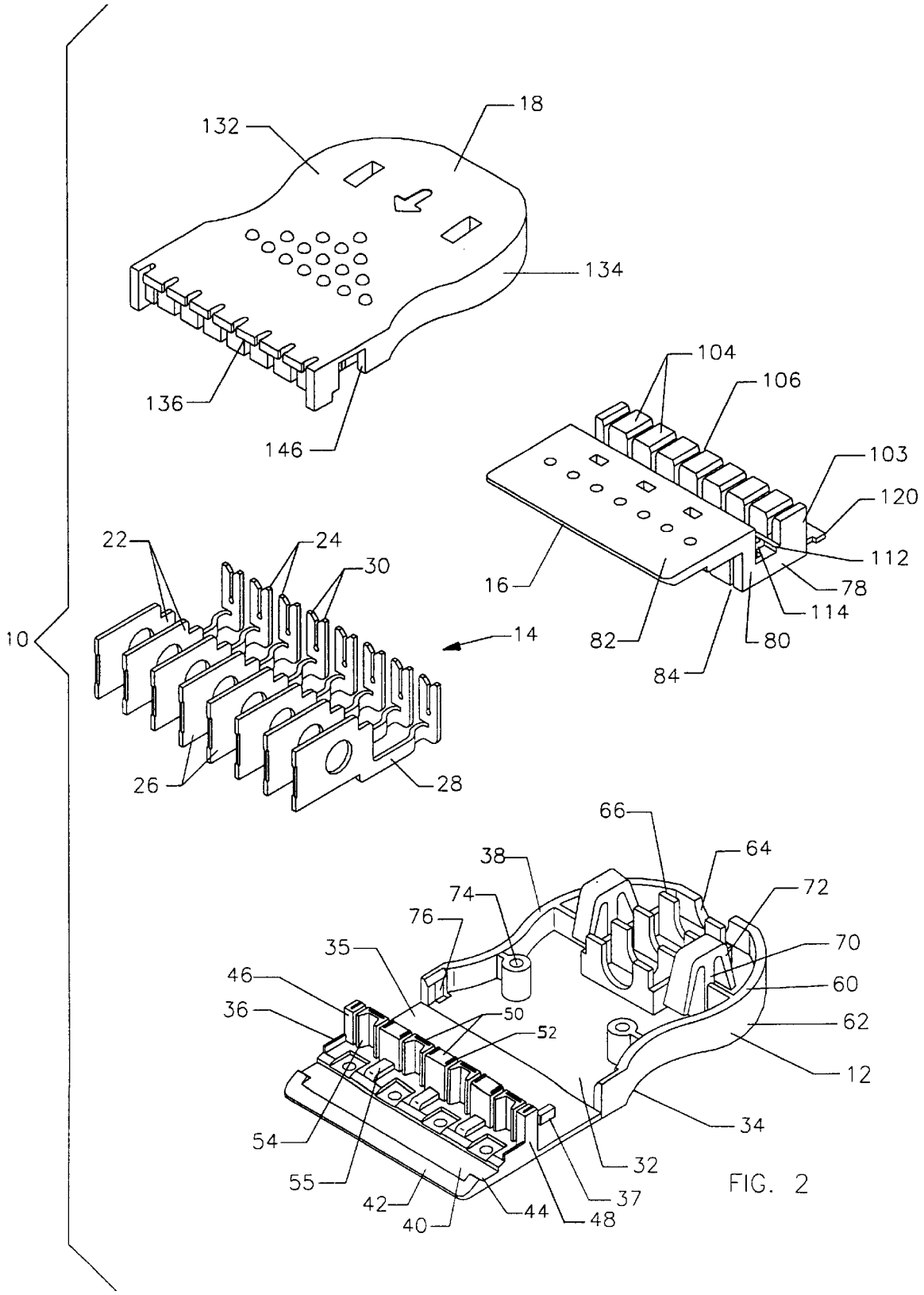
FIG. 2 is an exploded view of the patch plug shown in FIG. 1.

A patch plug 10 according to the present invention is shown in FIGS. 1 and 2. The patch plug includes a housing base 12, a plurality of spaced-apart electrical conductors 14, a conductor holder 16 and a cover 18. The housing base, conductor holder and cover are each preferably made of a plastic dielectric material. A cord 20 having a plurality of insulated wires (not shown) may be terminated by the patch plug as described below. A front end 19 of the patch plug defines an opening 21 for receiving a 110-type connector block (not shown) such as an array of insulation displacement contacts (first IDCs) from a cross-connect panel of the type described in U.S. Pat. No. 5,226,835.

In this case, the plurality of spaced-apart electrical conductors 14 includes eight contact pins 22, each contact pin having an upright insulation displacement contact 24 (second IDCs) at one end for receiving an individual wire from the cord 20, a contact blade 26 at the other end for insertion into the IDC of a 110-type connector block and a connector portion 28 connecting the insulation displacement contact 24 and the contact blade 26. The insulation displacement contacts 24 each have forked edges 30 that can pierce the insulation of the wire to make a contact.

Figure 3A:
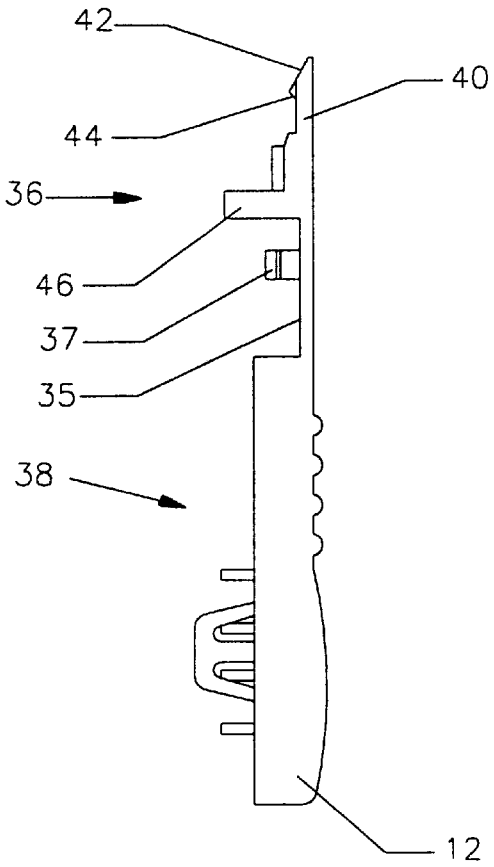
FIGS. 3A, 3B, and 3C are side, bottom and rear views, respectively, of a housing base of the patch plug according to the present invention.
Figure 3B:
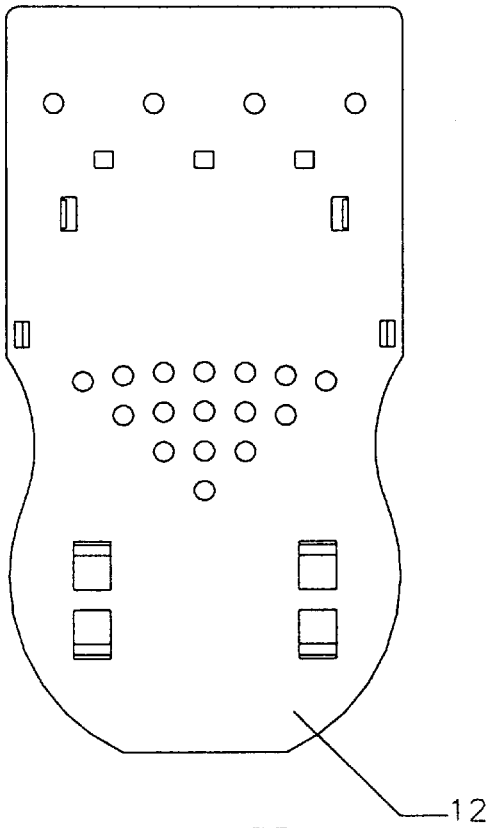
Figure 3C:
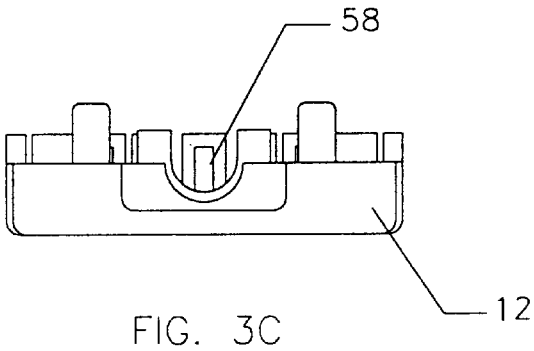

With reference also to FIGS. 3A–3C, the housing base 12 has an interior surface 32 and an exterior surface 34 and is divided into a front portion 36, a flat intermediate portion 35 (that may include posts 37 extending upwardly from the interior surface 32) and a back portion 38. The front portion includes a lower lip 40 that runs the full width of the housing base and defines the bottom boundary of the front opening 21 of the patch plug. A forward edge 42 of the front lip is beveled along the interior surface to more readily receive a 110-type connector block from a cross-connect panel. Inwardly from the beveled forward edge and extending upwardly from the interior surface at each side of the lower lip is a protrusion 44 for locking onto the 110-type connector block.

Spaced inwardly of the lower lip is a conductor support 46 that preferably runs the full width of the housing base and extends upwardly from the interior surface. The conductor support has two end walls 48 and is slotted between the end walls to form, in this case, seven interior columns 50 and eight slots 52 for receiving rear portions of the eight contact blades 26, respectively. Preferably, the front surface of alternate columns have channels 54 for mating with the 110-type connector block of the cross-connect panel. Similarly, keys 55 extend from the front of the remaining columns and are configured to mate with keyways of the 110-type connector block when mounted thereto. The channels 54 and keys 55 insure proper alignment and polarization of the patch plug to the 110-type connector block. The remaining columns also have recesses 58 extending up their backside from the interior surface 32 to a location near the top of the columns, which, as will be discussed, are used to secure the conductor holder 16 to the housing base 12.

The back portion 38 of the housing base 12 includes an outer wall 60 extending up from the interior surface 32 and defining an exterior wall surface 62 of the housing. At its back end, the outer wall has a semicircular cutout 64 for receiving the cord 20. Inwardly from the cutout are a plurality of longitudinally spaced U-shaped uprights 66 that provide strain relief to the cord when mounted in opposed relation to similar uprights 68 of the cover 18 (see FIG. 11).

Extending upwardly from the interior surface of the housing base on each side of the U-shaped uprights 66 is a post 70. A pair of downwardly and outwardly extending resilient arms 72 depend from opposing sides of the uppermost end of each post, which, as will be discussed, are used for latching the cover to the housing base. Preferably, the back portion 38 also has base alignment holes 74 for perfectly aligning the cover to the housing base and recesses 76 on the inner surface of the outer wall adjacent the intermediate portion 35 of the housing base to assist in latching the conductor holder to the housing base.

Figure 4A:
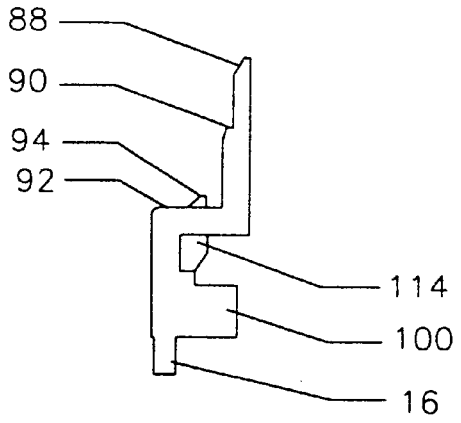
FIGS. 4A, 4B and 4C are side, top and bottom views, respectively, of a conductor carrier of the patch plug according to the present invention.
Figure 4B:
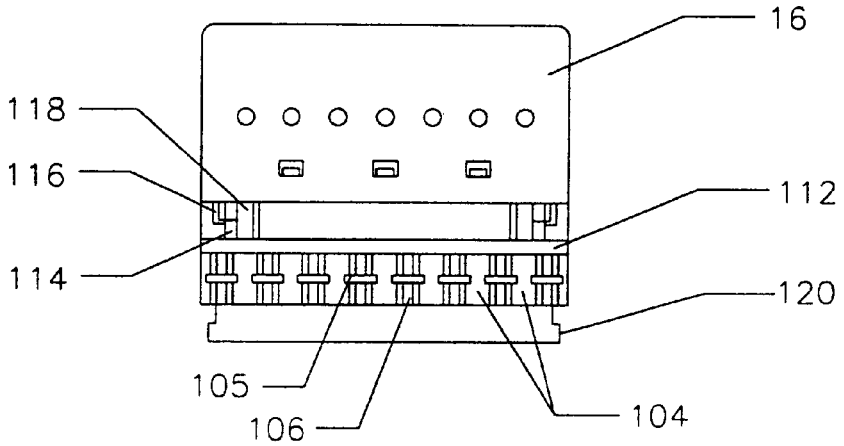
Figure 4C:
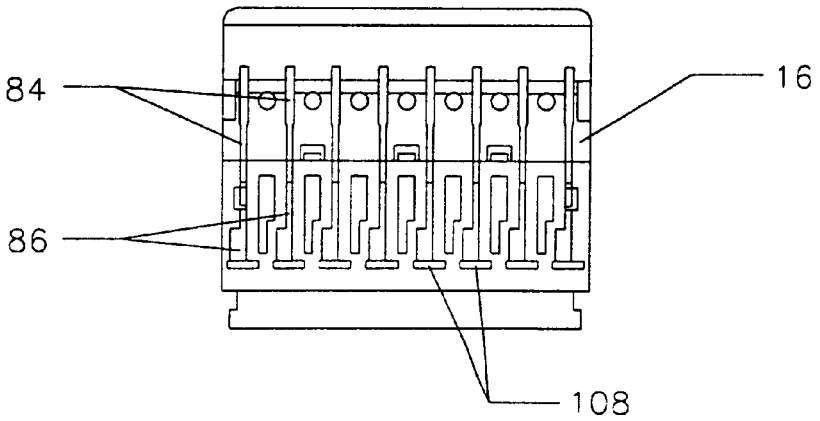

With reference also to FIGS. 4A–4C, the conductor holder 16 includes a bottom plate 78, an upwardly extending rear wall 80, and an upper lip 82 extending in a forward direction from the rear wall. Preferably, the bottom plate, the rear wall and the upper lip all extend the full width of the patch plug and have grooves 84, 86 along their inner surfaces to receive and hold the contact blades 26 and connector portions 28, respectively, of the conductors 14.

Figure 6:
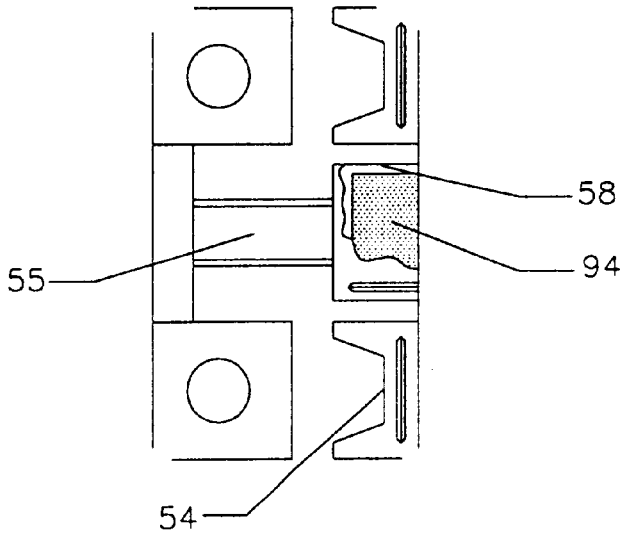
FIG. 6 is a top view of the housing base with a portion cut away to show an assembly detail.

A forward edge 88 of the upper lip is beveled along the interior surface to more readily receive a 110-type connector block. Inwardly from the beveled forward edge and extending downwardly from the interior surface is a ridge 90 running the full width of the patch plug that acts as a stop when the patch plug is mounted to the 110-type connector block. An outwardly facing surface 92 of the rear wall 80 includes protrusions 94 that mate with the recesses 58 of the housing base to secure the conductor holder to the housing base (see also FIG. 6).

Figure 9:
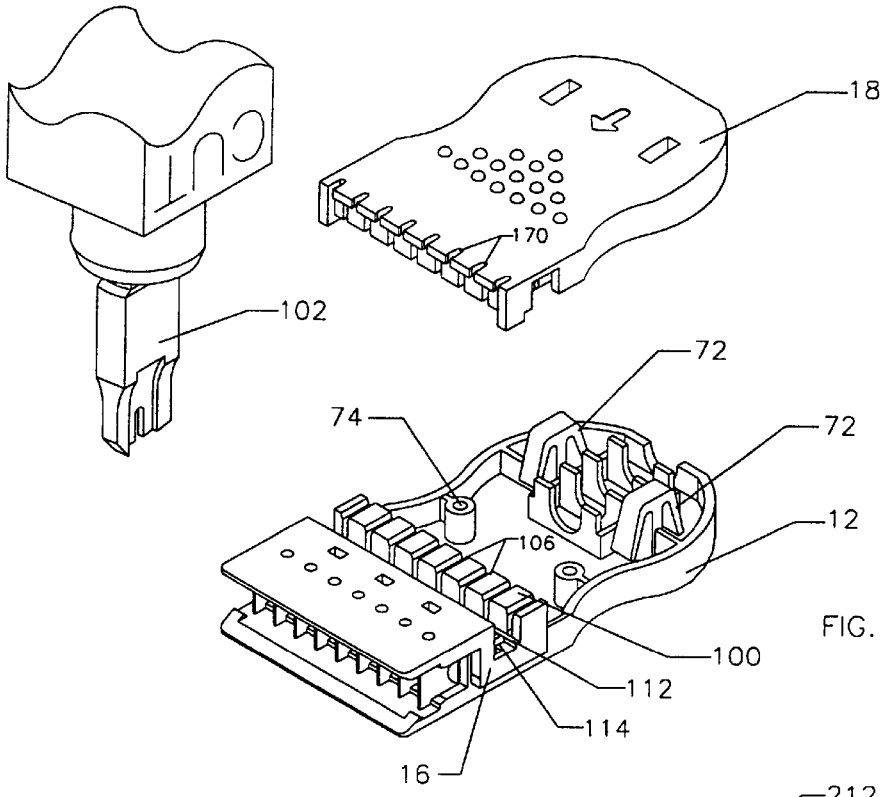
FIG. 9 is a perspective view of an assembled housing base and conductor carrier with an unassembled cover according to the present invention.

The conductor holder 16 includes a contact protection block 100 spaced sufficiently from the rear wall 80 to permit insertion of a punchdown tool 102 (see FIG. 9). Along the front of the contact protection block 100 is a tool block 112 which provides a sturdy base for use with a wire termination tool (e.g., a punchdown tool).

The contact protection block 100 preferably runs the full width of the patch plug. In this case, the contact protection block has two end walls 103 and is slotted to form seven interior columns 104 and eight slots 106 for receiving eight insulated wires (not shown). A widened portion 105 of the slot is provided at the mid-point of each slot to receive the insulation displacement contacts 24 of the contact pins 22. The insulation displacement contacts may enter the slots 106 through openings 108 in the bottom plate 78. The preferred contact protection block protects the front and back of the insulation displacement contacts from damage. Preferably, the columns 104 also extend above the insulation displacement contacts to further protect the contact pins.

Preferably, the bottom plate 78 includes an upwardly extending flange 114 secured between the rear wall 80 and the contact protection block 100. Each flange 114 includes a protrusion 116, which, as described later, may be used for securing the cover 18 to the contact holder 16. Adjacent each flange is a hole 118 in the bottom plate for receiving the posts 37 of the intermediate portion 35 of the housing base 12. The bottom plate 78 may also extend rearwardly of the contact protection block and may be provided with laterally extending latches 120 to engage recesses 76 of the housing base.

Figure 5:
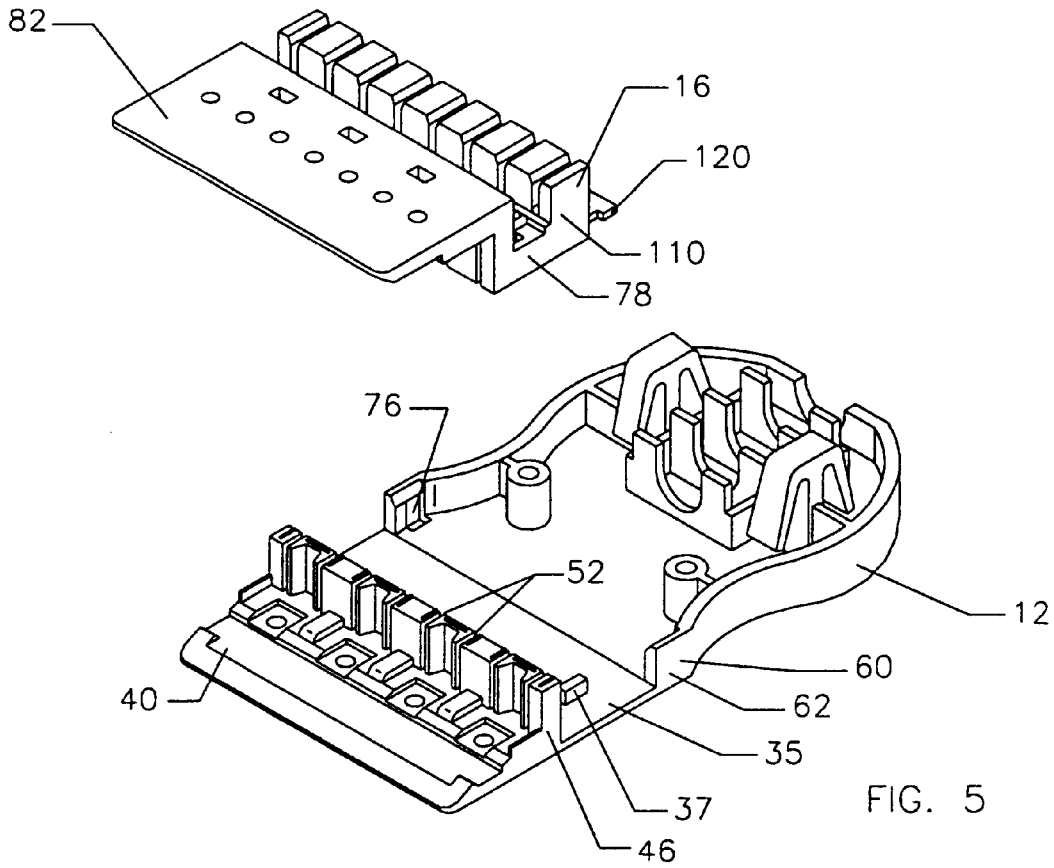
FIG. 5 is a perspective view of the housing base and unassembled conductor carrier according to the present invention.

With reference to FIGS. 2 and 5, assembly of the housing base 12 and conductor holder 16 will now be described. First, the contact pins 22 (not shown in FIG. 5) are inserted into the grooves 84, 86 of the conductor holder with the insulation displacement contacts of the contact pins inserted through the openings 108 in the bottom plate into the widened slots 105 of the contact protection block 100. Next, the bottom plate 78 of the conductor holder is pressed toward the flat intermediate portion 35 of the housing base between the contact support 46 of the housing base and the outer wall 60 of the housing base. As the conductor holder is pressed toward the housing base, the contact blades are positioned within the slots 52 of the conductor support of the housing base. When assembled, the posts 37 of the housing base are located in the holes 118 of the conductor holder, the protrusions 94 on the rear wall 80 of the conductor holder are snapped into recesses 58 of the conductor support of the holder base (see FIG. 6), and the laterally extending latches 120 are engaged in the recesses 76 of the housing base. Preferably, when assembled, an exterior surface 110 of the end walls of the contact protection block are flush with the exterior wall surface 62 of the outer wall of the housing base. In addition, the upper lip 82 and the lower lip 40 define the opening 21 that exposes the contact blades 26 for insertion into the 110-type connector block of the cross-connect panel (see FIG. 1).

Figure 7A:
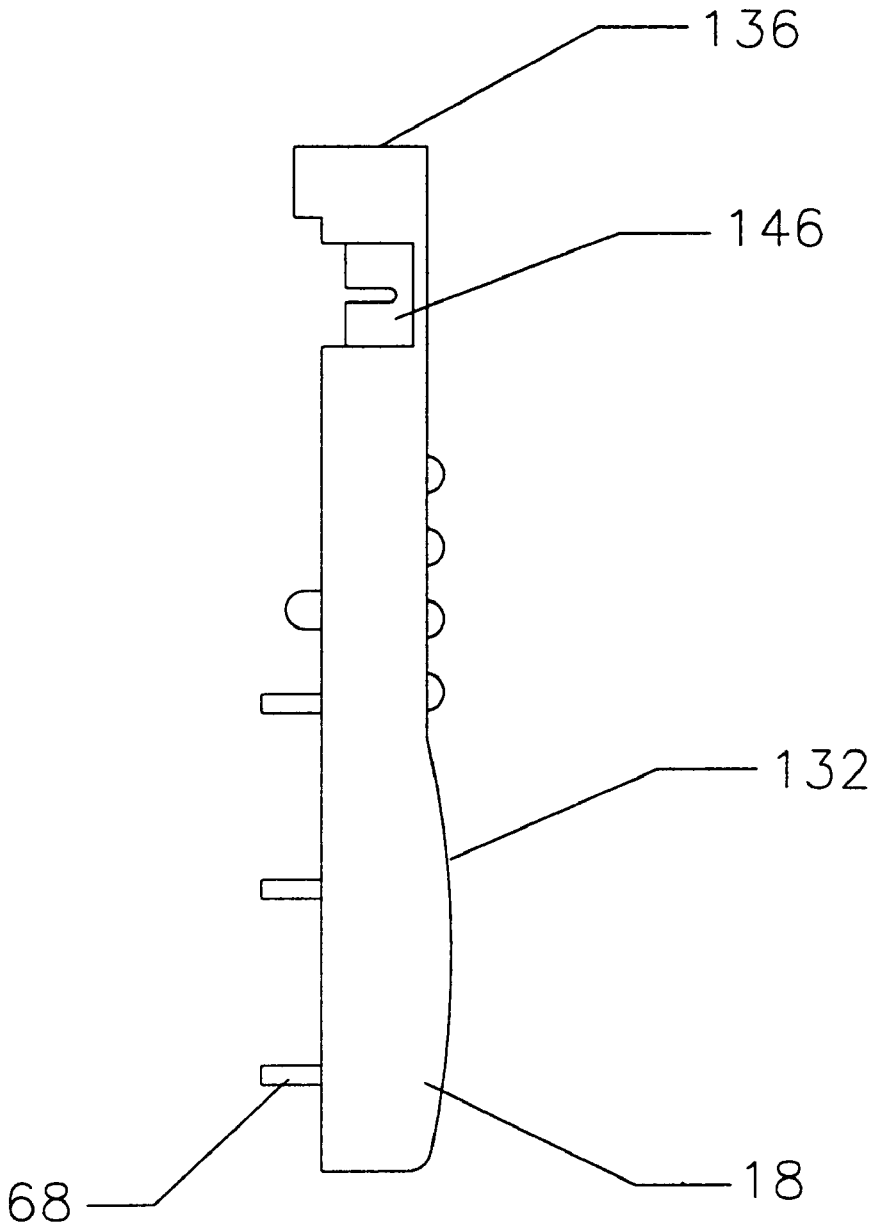
FIG. 7A is a side view of a cover of the patch plug according to the present invention.
Figure 7B:
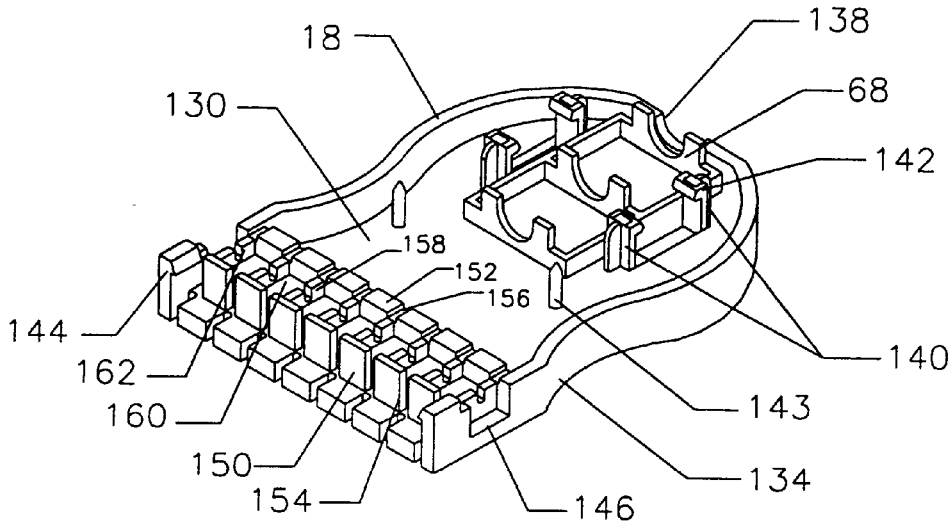
FIG. 7B is a perspective view of the inside surface of the cover of FIG. 7A.

With reference also to FIGS. 7A and 7B, the cover 18 has an interior surface 130, an exterior surface 132 and an outer wall 134 around the periphery of the cover except for a front end 136 thereof. At its back end, the outer wall 134 has a semicircular cutout 138 for receiving the cord 20. Inwardly from the cutout are a plurality of longitudinally spaced U-shaped uprights 68 that provide strain relief to the cord when opposed to the similar uprights 66 of the housing base (see FIG. 11). Extending outwardly from the interior surface of the cover on each side of the U-shaped uprights is a pair of brackets 140 each bracket having a protruding lip 142 for engaging the free ends of the resilient arms 72 that are mounted to the housing base.

Preferably, a pair of elongated pins 143 extend outwardly from the interior surface of the cover and are aligned with base alignment holes 74 of the housing base to align the cover and the housing base during assembly. In addition, latches 144 are provided on the inner surface of the outer wall adjacent the front end 136 of the cover to assist in latching the cover to the conductor holder. The outer wall of the cover also preferably includes a cutout 146 on each side adjacent the front end to receive the end walls of the contact protection block when assembled.

The interior surface of the cover is provided with longitudinally spaced front and rear wire guides 150, 152 defining a plurality of front and rear wire grooves 154, 156. Termination bars 158 are aligned with the front and rear wire grooves between the front and rear wire guides to assist the cover in forcing the insulated wires down to the proper depth inside the contact protection block to ensure insulation displacement and proper contact with the contact pins. Recesses 160 between the termination bars provide clearance for the top of the contact protection block. The termination bars each also have a cutout 162 to provide clearance for the insulation displacement contacts of the contact pins.

Figure 8:
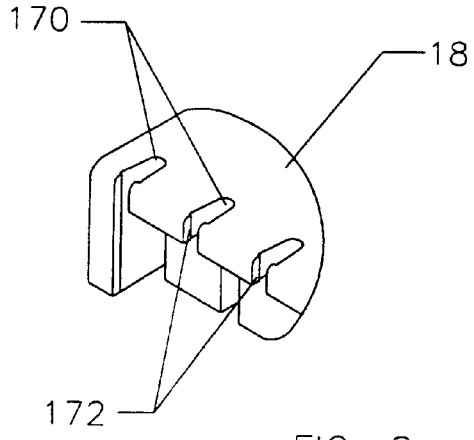
FIG. 8 is an enlarged perspective detail of the cover according to the present invention.

With reference to FIG. 8, the exterior surface of the front end of the cover 18 has a plurality of wire channels 170 to guide and organize the wires and to provide strain relief. In the preferred embodiment, the wire channels 170 have small tabs 172 at their open ends, which reduce the likelihood that the insulated wires will come out of the channels after installation. The wire channels reduce the necessity for precise trimming of the wires and also permits daisy chaining to an additional patch plug, if desired.

With reference to FIGS. 7B and 9, assembly of the cover 18 to the housing base 12 and the conductor holder 16 will now be described. The cover is first positioned above the housing base with the elongated pins 143 aligned above the base alignment holes 74. The cover is then guided toward the housing base until the brackets 140 engage the outwardly extending resilient arms 72. Further downward movement of the cover causes the resilient arms to deflect inwardly until the resilient arms snap behind the protruding lips 142 of the brackets. At the same time, the latches 144 of the cover engage the protrusions 116 on the flanges 114 of the conductor holder retaining the cover in place.

Manual termination of the insulated wires to the IDCs in the contact protection block may be achieved by inserting the individual wires (not shown) through the wire grooves 154, 156 of the cover. The wires may then be inserted up through the wire channels 170 through the exterior surface of the cover without the necessity of precise trimming. Each insulated wire will pass over a respective termination bar 158 of the cover. Wire termination is achieved by pushing the cover onto the contact protection block 100 of the conductor holder as discussed above. If desired, pliers may be used to generate the necessary force to cause the insulation displacement contacts of the contact pins to cut through the insulation of the wires and make proper contact.

Alternatively, termination may be achieved by using a punchdown tool 102. In this case, the insulated wires are inserted directly into the slots 106 of the contact protection block, then pushed down and simultaneously cut with the punchdown tool. The tool block 112 along the front of the contact protection block serves as a sturdy base for cutting by the punchdown tool. After the wires have been terminated, the cover may be assembled to the contact protection block, taking care to position the insulated wires into the proper slots of the cover. In this instance, the cover serves to retain the wires in place and to provide strain relief. The punchdown tool described herein is a standard tool that is well known in the industry.

Figure 10:
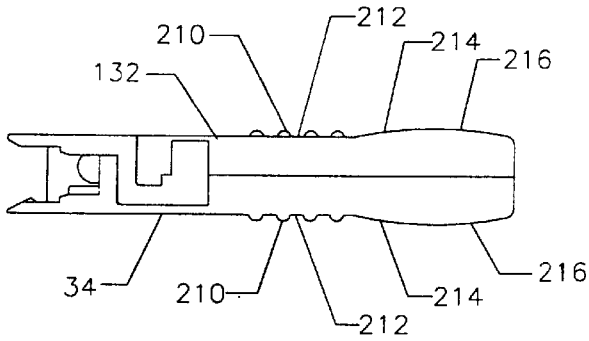
FIG. 10 is a side view of the patch plug shown in FIG. 1.

With reference to FIG. 10, the exterior surface 34 of the housing base and the exterior surface 132 of the cover are each provided with a grip relief 210 which provides a gripping surface to assist a user in removing and reinstalling a patch plug to a cross-connect panel as desired. The grip relief is preferably provided at intermediate portions 212 of the housing base and cover. Rearwardly of the grip reliefs, the exterior surfaces of the housing base and cover may be provided with a gradual incline or ramp surface 214, thus increasing the thickness of the patch plug in the longitudinal direction from the intermediate portion to a rear portion 216 of the patch plug. The ramp surface is to be distinguished from the grip reliefs 210, which do not as a whole provide a gradually inclining surface or a smooth surface against which a pulling force may be applied. The grip reliefs result in a higher concentrated force being applied to the thumb or finger of a person pulling on the patch plug than that which would be applied by the ramp surface.

Figure 11:
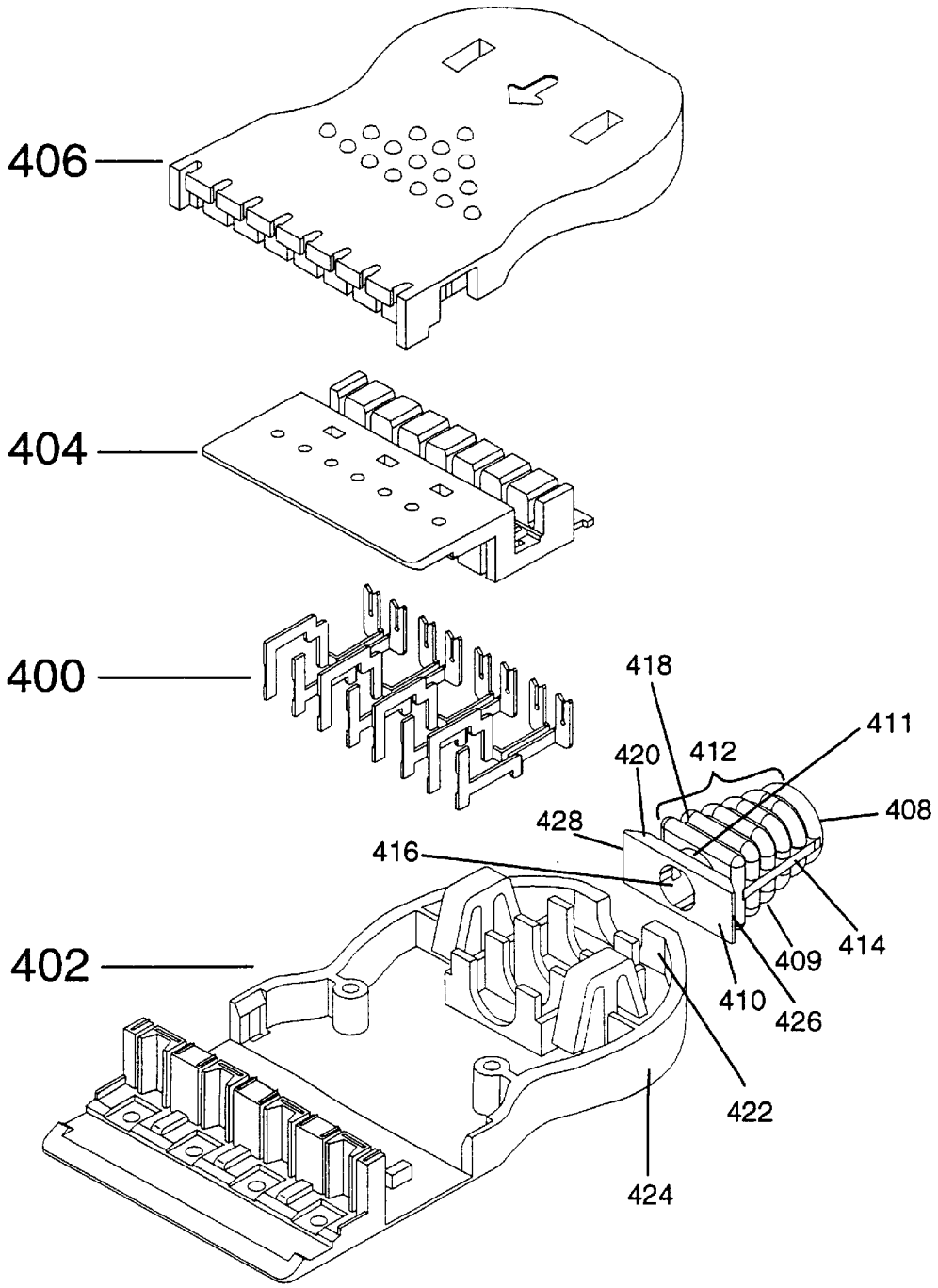
FIG. 11 is an exploded view of an alternative embodiment of the patch plug of the present invention.

With reference to FIG. 11 an alternative patch plug according to the present invention includes electrical conductors 400, a housing base 402, a conductor holder 404, a cover 406 and a strain relief boot 408.

Figure 12:
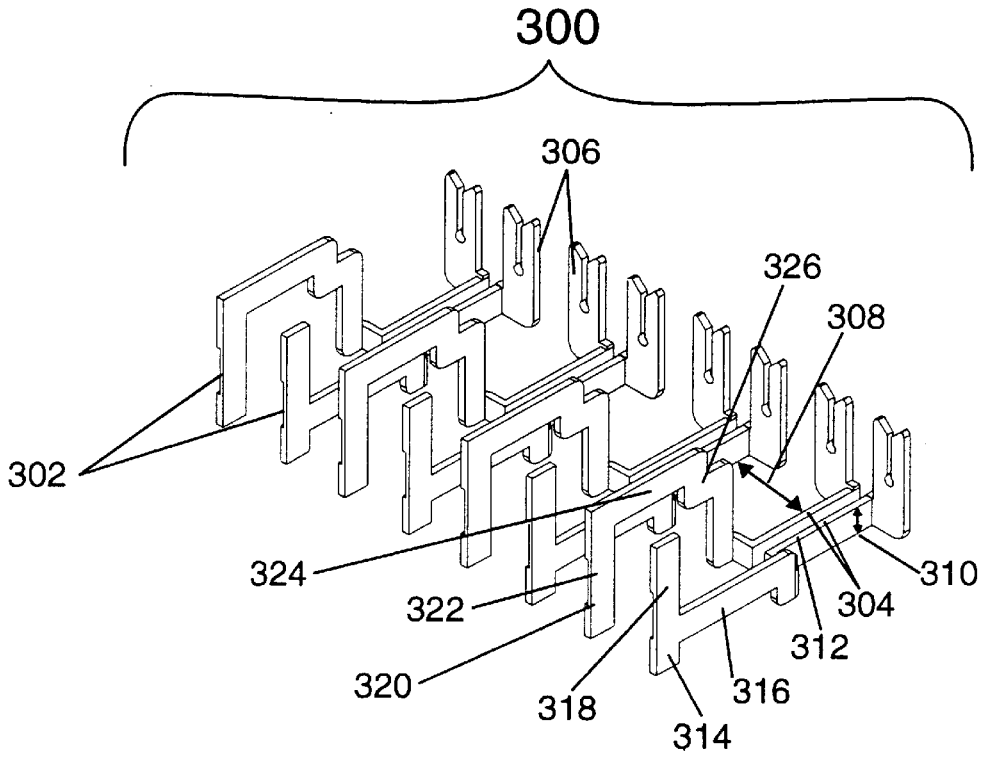
FIG. 12 is a perspective view of an alternative embodiment of electric conductors for a patch plug according to the present invention.
Figure 13:
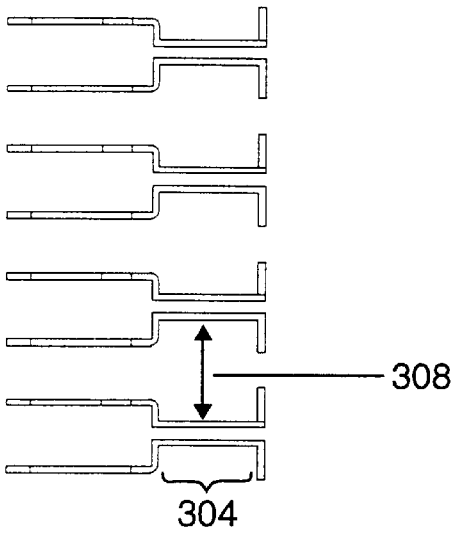
FIG. 13 is a top view of the electrical conductors of FIG. 11.

The electrical conductors 400 shown in FIG. 11 are more fully shown in FIGS. 12 and 13 and include electrical contact blades 302, electrical contact bars 304 and insulation displacement contacts (second IDCs) 306. The IDCs 306 are configured substantially as described above and as shown in FIG. 1. The electrical contact bars 304 extend longitudinally away from the IDCs 306 and connect the IDCs 306 to the contact blades 302. Each electrical contact bar 304 is generally "L" shaped when viewed from the top (See FIG. 13), and preferably has a greater width 310 than thickness 312. The electrical contact bars 304 are paired and the adjacent bars of each pair are offset toward one another. This increases the distance 308 between electrical contact bars of adjacent pairs of electrical conductors and helps to reduce crosstalk and electrical interference between adjacent electrical contact bars of different conductor pairs.

Preferably, each pair of electrical conductors has two different configurations of contact blades. The first configuration of contact blade 314 has an upright bar 318 and a lower longitudinal bar 316. The upright bar 318 is configured to be accepted by the array of IDCs to which the patch plug connects (not shown). The lower longitudinal bar 316 connects the bottom of the upright bar 318 to the electrical contact bar 304. This makes the first configuration of contact blade 314 appear to be generally "L" shaped when viewed from the side. The second configuration of contact blade 320 has an upright bar 322, an upper longitudinal bar 324 and a connector post 326. The upright bar 322 is configured to be accepted by the array of IDCs to which the patch plug connects (not shown). The upper longitudinal bar 324 connects the top of the upright bar 322 to the top of the connector post 326. In turn, the connector post 326 connects the longitudinal bar 324 to an electrical contact bar 304.

The two configurations of electrical contact blades are paired, and the pairs are arranged such that adjacent contact blades from adjacent pairs of blades are of opposite configurations. This arrangement of the two configurations of electrical contact blades 302 allows the longitudinal bars 316, 324 of adjacent blades to be a maximum distance from each other, and also creates minimum parallel exposure between the contact blades, thereby helping to reduce electrical interference and crosstalk between the circuits.

Figure 14:
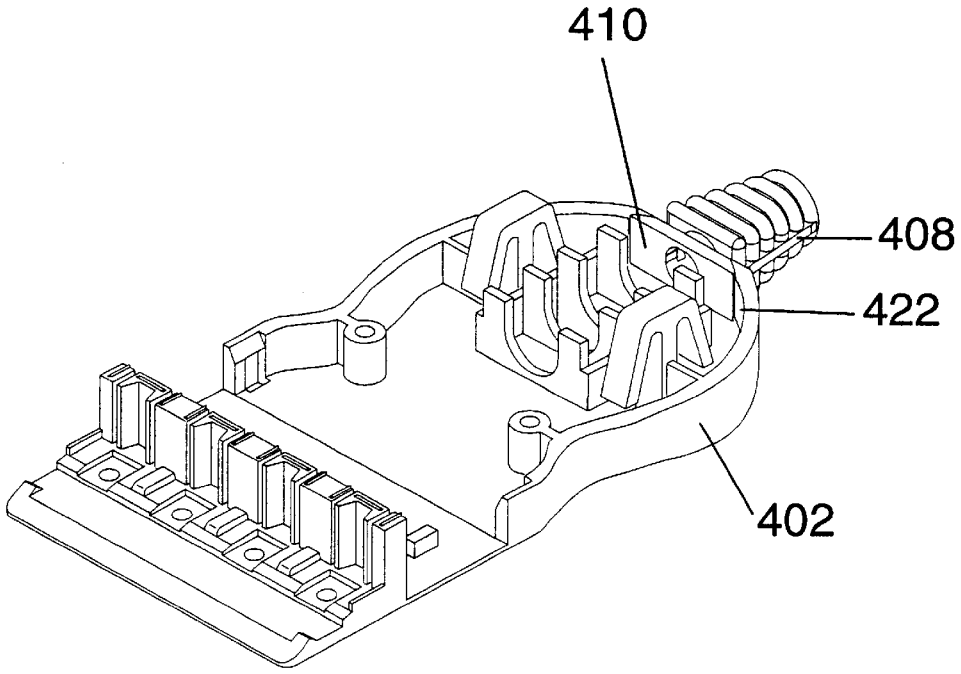
FIG. 14 is a partially assembled view of the bottom portion of the patch plug of FIG. 11.
Figure 15:
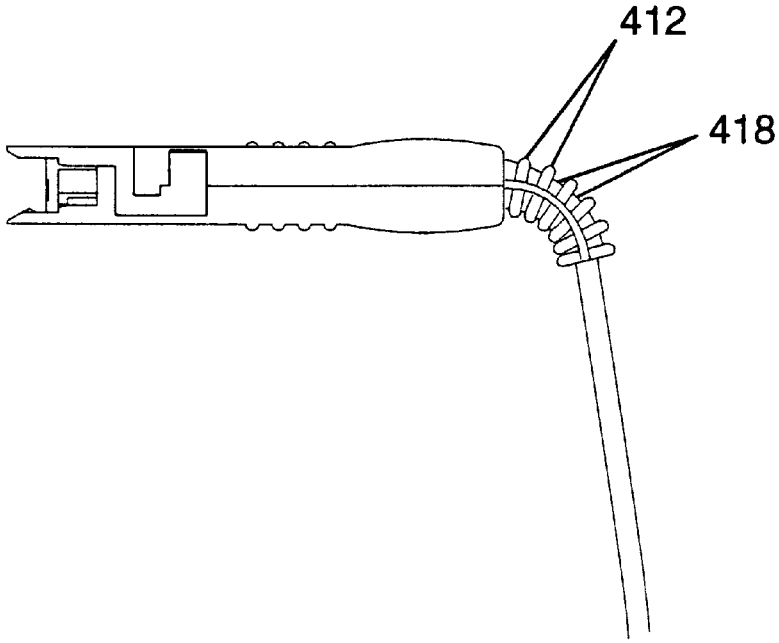
FIG. 15 is a side view of the patch plug of FIG. 11 and a terminal cord.

With reference to FIG. 11, the strain relief boot 408 is made of a flexible, dielectric material, such as plastic, and includes a boot portion 409 and an anchor 410. The boot portion 409 includes a tube, 411, transverse ribs 412 arranged peripherally around the tube 411, and opposed longitudinal ribs 414 arranged along the axis of the tube 411. The anchor 410 is rectangular in shape and has a greater width than height. The anchor 410 is placed inside the housing base 402 (See FIG. 14) so that an inner side 420 of the anchor 410 is braced against an inner side 422 of an outer side wall 424 of the housing base 402. The anchor 410 has a right edge 426 and a left edge 428, which may be beveled to ensure a tighter fit with the inner side 422 of the outer side wall 424. The remainder of the strain relief boot 408 projects outside of the housing base 402. When the patch plug is fully assembled, the strain relief boot 408 is firmly held in place by the anchor 410 contacting the inner side 422 of the outer wall 424.

The strain relief boot 408 also has an opening 416 formed by the tube 411, through which a cord (not pictured) may be inserted. The transverse ribs 412 are configured so that there are small gaps 418 between each rib 412. These gaps 418 allow the strain relief boot 408 to bend (See FIG. 13) so that the small gaps are compressed on one side of the strain relief boot and expanded on the other. Once the transverse ribs 412 are compressed together they resist further compression, therefore, the strain relief boot 408 is prevented from bending further in the same direction. Because the transverse ribs 412 only compress a given amount, they force the strain relief boot 408 to bend over a predetermined circumference and therefore prevent sharp ninety-degree bends in the cord inserted through the strain relief boot 408. The longitudinal ribs 414 serve to strengthen the strain relief boot 408 during bending.

From the foregoing, it will be appreciated that the patch plug of the present invention has a contact protection block that protects the insulation displacement contacts of the contact pins from damage, despite the limitation on width size of patch plugs that are used on 110-type connector blocks. The patch plug also has ramped surfaces extending longitudinally which permit easier grasping and removal of the patch plug from the 110-type connector block even when many patch plugs are mounted side-by-side. The patch plug of the present invention is also easily installed in the field either via cover termination or tool termination. The patch plug of the present invention also reduces or prevents crosstalk and signal interference between circuits. In addition, the patch plug of the present invention provides strain relief for the cord which is attached to it.

While a particular form of the invention has been illustrated and described, it will be apparent that various modifications can be made without departing from the spirit and scope of the invention. In particular, while the patch plug has been described with regard to a four pair patch, the present invention may also be configured in any other required configuration, including one, two or three pair configurations. Accordingly, it is not intended that the invention be limited except by the appended claims.

We claim:

1. A patch plug for connecting a plurality of communication wires to a plurality of first insulation displacement contacts, comprising:

at least two pairs of spaced-apart electrical conductors, each conductor of each pair of spaced-apart electrical conductors having a front end forming a contact blade and a back end forming a second insulation displacement contact, each of the second insulation displacement contacts configured to receive, in conductive engagement, a respective one of the plurality of communication wires, each contact blade configured to be received, in conductive engagement, into a respective one of said plurality of first insulation displacement contacts; and a dielectric housing containing the at least two pairs of spaced-apart electrical conductors and maintaining each conductor of each pair of spaced-apart electrical conductors aligned in predetermined positions without any one conductor crossing an adjacent conductor and maintaining the second insulation displacement contacts rearwardly of their respective blades;

wherein each conductor of each pair of spaced-apart electrical conductors has an electrical contact bar connecting the front end to the back end;

wherein the two pairs of electrical conductors are configured such that the electrical contact bars are substantially parallel to one another; and wherein adjacent electrical contact bars of the same pair are closer together than adjacent electrical contact bars of different pairs to reduce electrical interference between the two pairs of electrical conductors.

2. A patch plug for connecting a plurality of communication wires to a plurality of first insulation displacement contacts, comprising:

a plurality of spaced-apart electrical conductors, each one of said plurality of spaced-apart electrical conductors having a front end forming a contact blade and a back end forming a second insulation displacement contact, each of the second insulation displacement contacts configured to receive, in conductive engagement, a respective one of the plurality of communication wires, each contact blade configured to be received, in conductive engagement, into a respective one of said plurality of first insulation displacement contacts; and a dielectric housing containing the plurality of spaced-apart electrical conductors and maintaining the conductors aligned in predetermined positions such that the second insulation displacement contacts are disposed rearwardly of their respective blades;

wherein the dielectric housing includes an outer side way with a rear end, an interior face and an exterior face;

wherein the rear end defines an opening; and a strain relief boot comprising a tube of dielectric, flexible material suitable for receiving an insulated wire;

wherein the strain relief boot is secured in the opening of the rear end and has an elongated portion that extends out from the rear end;

wherein the tube has an interior end and extending transversely away from the tube at the interior end is an anchor which is substantially rectangular and has a width and a height;

wherein the width of the anchor is greater than height of the anchor and the anchor is in contact with the interior face of the outer side wall; and wherein the anchor has a left edge and a right edge and wherein the left edge and the right edge are beveled to ensure a tighter fit with the interior face of the outer side wall.

3. The patch plug of claim 1 wherein two adjacent contact blades of the at least tow pairs of spaced-apart electrical conductors include a first contact blade having a first configuration and a second contact blade having a second configuration;

wherein each of the first and second configurations includes an upright bar forming a blade portion that is initially received in a respective one of the plurality of first insulation displacement contacts when the patch plug in connected to the plurality of first insulation displacement contacts, wherein each upright bar has an upper end and a lower end;

wherein the first configuration includes a lower longitudinal bar extending rearwardly from the lower end of the upright bar toward its respective second insulation displacement contact; and wherein the second configuration includes an upper longitudinal bar extending rearwardly from the upper end of the upright bar toward its respective second insulation displacement contact.

4. The patch plug of claim 3 wherein the second insulation displacement contacts are aligned in a single row.

5. The patch plug of claim 4 wherein the dielectric housing includes a contact protection block formed around the single row of second insulation displacement contacts, the contact protection block defining a plurality of slots, each one of said plurality of slots for receiving and guiding a respective one of said plurality of communication wires into conductive engagement with the second insulation displacement contacts of each one of said plurality of spaced-apart electrical conductors.

* * * * *